US005746430A

United States Patent [19]

Chester

[11] Patent Number: 5,746,430

[45] Date of Patent: May 5, 1998

[54] MAGNETIC TANGRAM PUZZLE GAME ASSEMBLY

[76] Inventor: Mark S. Chester, P.O. Box 640501, San Francisco, Calif. 94164-0501

[21] Appl. No.: 801,961

[22] Filed: Feb. 18, 1997

[51] Int. Cl.[6] ..... A63F 9/10

[52] U.S. Cl. ..... 273/157 R

[58] Field of Search ..... 273/153 R, 157 R

[56] References Cited

U.S. PATENT DOCUMENTS

| | | | |
|---|---|---|---|
| 2,002,077 | 5/1935 | Darling et al. | 273/157 R |
| 2,506,189 | 5/1950 | Attridge | 273/157 R |
| 3,433,485 | 3/1969 | Renn et al. | 273/157 R |
| 3,473,807 | 10/1969 | Leonard | 273/157 R |
| 4,298,200 | 11/1981 | Kanbar | 273/157 R |
| 4,436,307 | 3/1984 | Caldwell | 273/157 R |
| 4,938,472 | 7/1990 | Gould et al. | 273/157 R |
| 5,158,295 | 10/1992 | Shilling | 273/157 R |

*Primary Examiner*—Steven B. Wong
*Attorney, Agent, or Firm*—Michael Ebert

[57] ABSTRACT

A Tangram puzzle game assembly in which the game is played with a set of geometric pieces formed of plastic material having magnetized particles dispersed therein. Also provided is a ferromagnetic playboard on which the pieces are placed by a player and interfitted to create a Tangram figure whose shape depends on how the pieces are interfitted, the pieces being magnetically attracted to the board to maintain their respective positions. The pieces are stored in a tray having a side wall provided with an elongated slot to socket the lower end of the playboard to support the board at a tilted upright position, thereby facilitating placement of the pieces on the board as the player observes a Tangram puzzle to be solved printed on the face of a playing card.

7 Claims, 2 Drawing Sheets

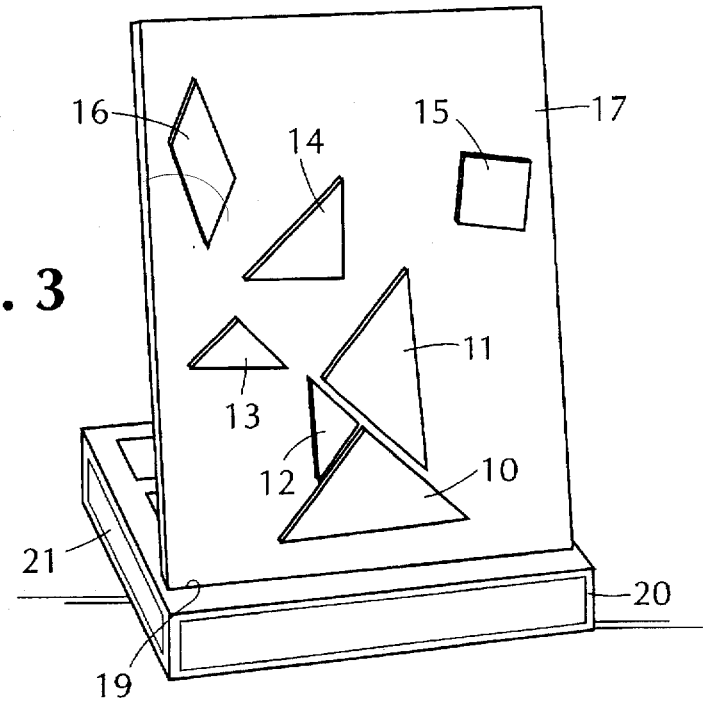
FIG. 3
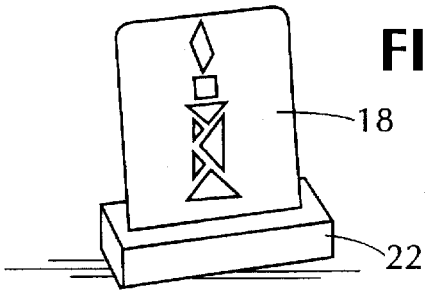
FIG. 5
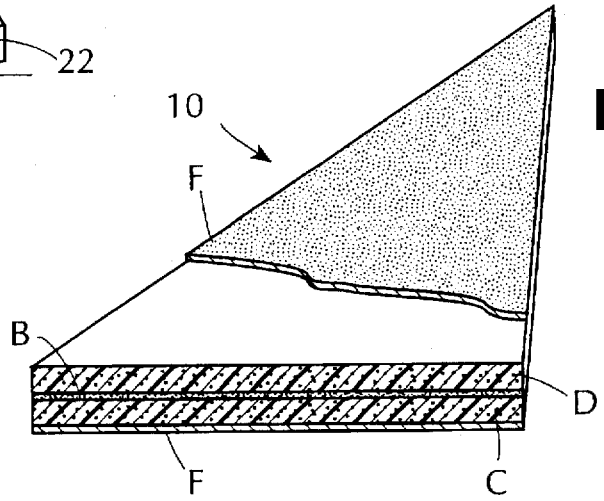
FIG. 8
FIG. 9
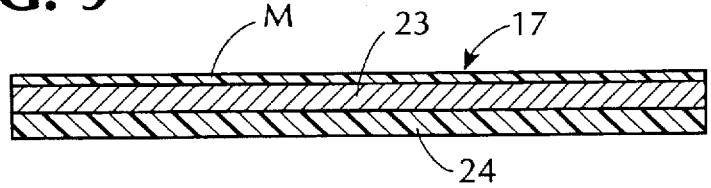

MAGNETIC TANGRAM PUZZLE GAME ASSEMBLY

BACKGROUND OF INVENTION

1. Field of Invention

This invention relates generally to Tangram puzzles, and more particularly to a Tangram puzzle game assembly in which the magnetic Tangram pieces adhere magnetically to a ferromagnetic playboard.

2. Status of Prior Art

Tangram is a puzzle game of ancient Chinese origin. To the extent that it is made up of interfitting pieces, it is comparable to a jigsaw puzzle. But jigsaw pieces can be interfitted in only one way, whereas one may fit together Tangram pieces in many ways to create a great variety of shapes or patterns.

A Tangram consists of seven geometric pieces derived from a large square. A Tangram set is made up of two large triangles, two small triangles and a medium-sized triangle, plus a small square and a rhomboid. From these pieces the player is able to create figures that may be geometrical, abstract or representational in form, depending on how the pieces are interfitted. Thus the player can create human or animal silhouetted figures in various postures, as well as silhouetted bridges, houses or other architectural configurations.

Currently available Tangram pieces are die cut or otherwise derived from a rigid, black plastic panel. When these black geometric pieces are fitted together, the junctions therebetween are not apparent. But if the pieces are placed on a white background and slightly separated, the junctions therebetween are rendered visible as thin white lines. A number of Tangram books have been published that contain hundreds of illustrations of different Tangram figures. Each figure is a puzzle which can be solved by so fitting the pieces of a single Tangram set to recreate the illustrated figure.

Each figure in the Tangram book is illustrated without junction lines between the pieces. Hence a player has no way of knowing what arrangement of interfitting pieces will produce the illustrated figure other than the profile of the figure which affords a clue to this end. The player, after selecting a figure in the book for play, then proceeds to fit the Tangram pieces together in an attempt to recreate the same figure. The book also contains an illustrated solution to each figure. The solution is the same figure, but with the Tangram pieces slightly separated from each other to expose the junction lines therebetween so that the pieces are then individually defined.

Thus what is usually marketed is a package containing a set of Tangram pieces and a book illustrating different puzzle figures which can be formed from these pieces, the book also including solution figures. As so marketed, Tangram represents a puzzle which best lends itself to play by a solitary player. While it is possible for two players having their own sets to compete in recreating a Tangram figure, this game has limited play value, particularly since the game would have to be played by consulting a Tangram book.

In the Kanbar U.S. Pat. No. 4,298,200, there is disclosed a Tangram puzzle game assembly for competitive play which contains two sets of Tangram pieces, each capable of creating a variety of geometric or representational figures.

Also included is a deck of cards, each having printed on its front face a Tangram puzzle figure, and on its rear face the solution to this puzzle. In play, a card is withdrawn from the deck and its front face presented to both players who with their respective sets of Tangram pieces then race to recreate the figure displayed on the card.

The practical difficulty with a conventional Tangram set as well as with the set disclosed in the Kanbar patent is that in interfitting the pieces to recreate a figure shown in a book or on a card, the pieces must be laid down and interfitted on a horizontal surface such as on a table, while observing the Tangram puzzle figure in the book or on the card.

In carrying out this operation under the stress of a race with an opposing player who seeks to be the first to solve the Tangram puzzle, it becomes difficult to place Tangram pieces at fixed positions on the horizontal playing surface, for the pieces are of smooth plastic and slide easily on this surface. Thus in laying down one piece one may upset the position of adjacent pieces previously laid down.

Moreover, when the Tangram puzzle printed on the front face of a card supported at an upright position, as in the Kanbar patent, so that it can best be viewed by both players, as a player then places pieces on a horizontal playing surface, he must shift his gaze from the upright card to this surface. This action interferes with the player's ability to quickly recreate the Tangram puzzle figure.

SUMMARY OF INVENTION

In view of the foregoing, the main object of this invention is to provide a Tangram puzzle game assembly in which the geometric pieces in the set have magnetic properties and therefore magnetically adhere to a playboard formed of ferromagnetic material.

A significant advantage of a magnetic Tangram set is that the playboard may be mounted at a tilted upright position to facilitate placement of the Tangram pieces thereon which are magnetically maintained at their respective positions on the playboard.

More specifically, an object of this invention is to provide an assembly of the above type in which the pieces which make up a Tangram set are stored in a tray which also serves as a mount for supporting the playboard at a tilted upright position.

Also an object of this invention is to provide a Tangram set whose magnetic pieces are formed by interlaminated layers, each of which is composed of synthetic plastic material having dispersed therein magnetized ferrite particles whereby both sides of each piece are magnetic.

Briefly stated, these objects are attained by a Tangram puzzle game assembly in which the game is played with a set of geometric pieces formed of plastic material having magnetized particles dispersed therein. Also provided is a ferromagnetic playboard on which the pieces are placed and interfitted to create a Tangram figure whose shape depends on how the pieces are interfitted, the pieces being magnetically attracted to the board to maintain their respective positions.

The pieces are stored in a tray having a side wall provided with an elongated slot to socket the lower end of the playboard to support the board at a tilted upright position, thereby facilitating placement of the pieces on the board as the player observes a Tangram puzzle to be solved printed on the face of a playing card.

BRIEF DESCRIPTION OF DRAWING

For a better understanding of the invention, as well as other objects and further features thereof, reference is made to the following detailed description to be read in conjunction with the accompanying drawings, wherein:

FIG. 3 illustrates, in perspective, a tray for storing the pieces of a Tangram set, the tray also serving to support a playboard at a tilted upright position;

FIG. 5 shows a stand for supporting a playing card at a tilted upright position;

FIG. 8 shows a part of one laminated Tangram piece; and

FIG. 9 shows a part of the playboard.

DETAILED DESCRIPTION OF INVENTION

Figure 1:
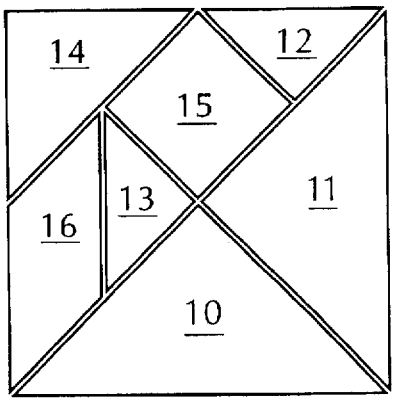
FIG. 1 illustrates the seven basic geometric pieces of a Tangram.
Figure 4:
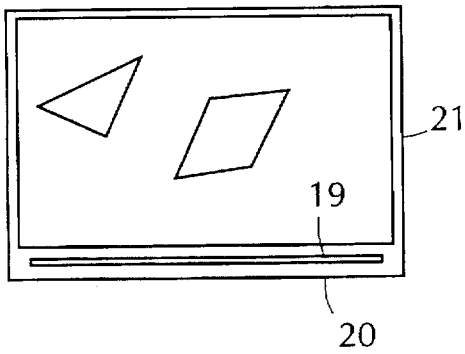
FIG. 4 is a plan view of the tray.

Referring now to FIG. 1, there is shown a full set of Tangram pieces derived from a planar square. The set is composed of two large triangles 10 and 11, two small triangles 12 and 13, a medium-sized triangle 14, a small square 15 and a rhomboid 16.

As is well known, Tangram pieces may be fitted together to create a wide range of different geometric or representational forms. In FIGS. 2A to 2I, nine geometric Tangram figures are illustrated with the pieces slightly spaced from each other. Hence one seeing these figures would know how to recreate the same shapes, since the pieces are distinctly defined. These figures therefore represent Tangram solutions.

Figure 2:
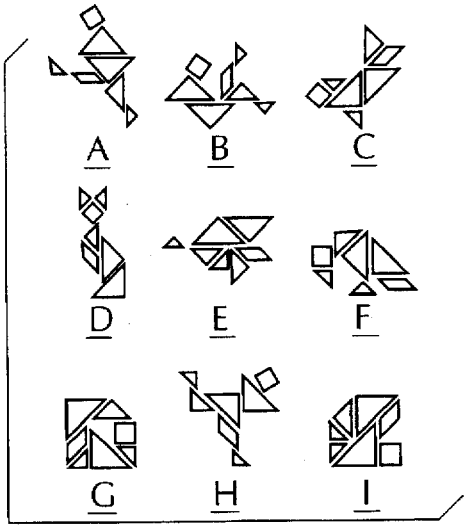
FIG. 2 is a collection of different geometric forms created from the seven pieces.

A Tangram puzzle, say in the shape of FIG. 2A, would have the pieces in abutting relation, thereby erasing the junction lines, so that the player would have to exercise his visual imagination to recreate the same figure. Hence a Tangram figure represents a puzzle when one seeing the figure is unable to tell how the pieces which make up the figure are to be interfitted. All of the pieces which make up a Tangram set in accordance with the invention are magnetic, hence they will magnetically adhere to a ferromagnetic playboard, such as one that includes a sheet of an iron alloy or steel.

To this end, as shown in FIG. 8 in connection with Tangram pieces 10, the square panel from which this piece is die cut is a laminate. The laminate is composed of two like layers C and D joined together by a thermoplastic foam bonding agent B having an affinity for the thermoplastic material of the layers. Layers C and D are formed of PVC or other suitable thermoplastic material having ferrite particles uniformly dispersed therein.

Ferrites are ceramic magnetic materials which in a "hard" form are capable of storing a significant amount of magnetic energy. This is why hard ferrites are used as permanent magnets in small motors and loudspeakers. Hence when the ferrite particles dispersed in the layers C and D are magnetized, the resultant laminate of these layers functions as a permanent magnet. The overall thickness of the laminate is preferably about 3/16th of an inch, hence each thin piece is rigid.

To impart color to the pieces of the Tangram set, the square panel from which the pieces are die cut may have adhered to its opposing faces a thin film F of synthetic plastic material, such as polyethylene, having the desired color. Thus one set of Tangram pieces may have a red color and the other set a green color.

The seven magnetic pieces which make up a Tangram set are placed on a rectangular play board 17, as shown in FIG. 3 on which the pieces are interfitted to recreate Tangram figure shown on a playing card, such as card 18 in FIG. 5.

The lower end of playboard 17 is inserted in a lengthwise slot 19, cut in the front side wall 20 of a rectangular tray 21 in which the Tangram pieces are stored when not in use. Slot 19 which sockets the playboard maintains it in a tilted upright position so that it is easily viewed by a player. Card 18 is maintained in a like tilted upright position by a stand 22 having a slot therein to socket the lower end of the card. Since the game requires two sets of Tangram pieces, two trays are provided, one for each set.

Thus as a player views upright card 18 which displays a particular Tangram figure to be reproduced, the player then applies the pieces of the set onto play board 17 and interfits these pieces to recreate the figure on the card.

Playboard 17, as shown separately in FIG. 9, is formed of a sheet 23 of ferromagnetic material, such as steel whose exposed face is lined by a thin protective plastic film M, such as Mylar laminated to the panel to provide a smooth friction-free surface. Sheet 23 is laminated to a backing board 24.

While the magnetic play pieces are each slidable on the Mylar surface of the ferromagnetic playboard, they are magnetically attracted thereto, so that the adjusted positions of the play pieces are maintained.

In practice, a deck of cards is provided, each card carrying a different Tangram figure to be recreated by the two players, the winning player being the one who is first to create the figure.

Figure 6:
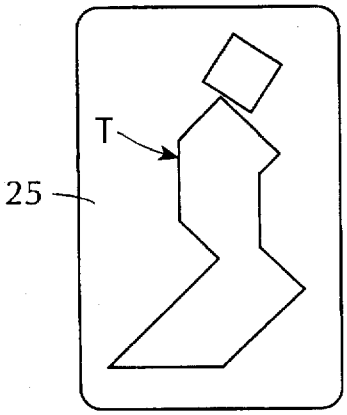
FIG. 6 shows the front face of one of the playing cards in the deck.
Figure 7:
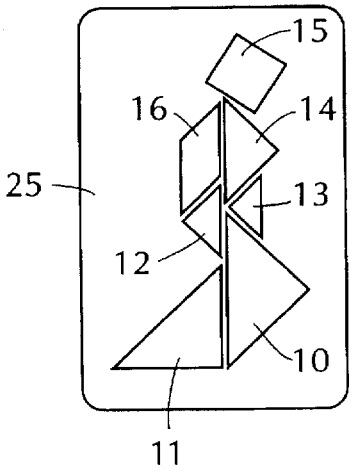
FIG. 7 is the rear face of the same card.

FIG. 6 shows front face of one card 25 from a card deck, and FIG. 7 shows the rear face thereof. FIG. 6 carries a Tangram puzzle figure T, while FIG. 7 shows the same figure with a slight separation between the pieces 10 to 16, so that this figure is the solution to the puzzle.

In playing, the players who see the puzzle figure on the presented card then simultaneously proceed with their sets of pieces to recreate the figure as quickly as they can. The first to succeed, as confirmed by the solution on the rear face, is awarded the card. This activity is repeated with each card withdrawn from the deck. The player who is awarded the greatest number of cards is the winner.

The advantage of a laminated plastic structure for the Tangram play pieces is that it resists any tendency of the plastic pieces to bend. It is important for the pieces to interfit properly, and they therefore should be perfectly planar.

The advantage of a tilted upright playboard and a tilted upright playing card to be observed by a player as he places pieces on the board, is that the player's eyes do not shift markedly in carrying out this operation, as would be the case had it been necessary to place the pieces on a horizontal playing surface.

And the advantage of magnetic Tangram play pieces is that when placed on a ferromagnetic playing board at particular positions, they are maintained at these positions.

While there has been shown and described a magnetic Tangram puzzle game assembly in accordance with the application, it will be appreciated that many changes and modifications may be made therein without, however, departing from the essential spirit thereof.

I claim:

1. A Tangram puzzle game assembly comprising:

A. a Tangram set of magnetized geometric pieces derived from a square;

B. a ferromagnetic playboard on which the pieces are placeable and adhere thereto by magnetic attraction to create a figure by interfitting the pieces of the set; and C. a tray having a cavity for storing the set of pieces and a raised side wall provided with an elongated slot adapted to socket a lower end of the playboard to hold the playboard at a tilted, upright position to facilitate the placement of the pieces thereon.

2. An assembly as set forth in claim 1, in which the magnetic pieces are formed of synthetic plastic material having ferrite particles dispersed therein.

3. An assembly as set forth in claim 2, in which the pieces are formed by laminated layers of said synthetic plastic material whereby both sides of the pieces are magnetic.

4. An assembly as set forth in claim 3, in which said layers are formed of said thermoplastic material laminated together by a thermoplastic bonding agent.

5. An assembly as set forth in claim 4, having a colored plastic film adhered to outer surfaces of the layers to impart color to the pieces.

6. An assembly as set forth in claim 1, further including a deck of playing cards, each card having on its front face a Tangram figure in which the pieces from which this figure is created are not separately defined, and having on its rear face the same figure with the pieces separately defined.

7. An assembly as set forth in claim 6, further including a stand having a slot therein to socket a lower end of the card to support the card in a tilted upright position.

* * * * *